US011459719B2

(12) United States Patent
Gedstad

(10) Patent No.: US 11,459,719 B2
(45) Date of Patent: Oct. 4, 2022

(54) DOCK LEVELING SYSTEM

(71) Applicant: Orvin Gedstad, Lake Norden, SD (US)

(72) Inventor: Orvin Gedstad, Lake Norden, SD (US)

( * ) Notice: Subject to any disclaimer, the term of this patent is extended or adjusted under 35 U.S.C. 154(b) by 141 days.

(21) Appl. No.: 17/089,004

(22) Filed: Nov. 4, 2020

(65) Prior Publication Data

US 2022/0136195 A1 May 5, 2022

(51) Int. Cl.
*E02B 3/06* (2006.01)

(52) U.S. Cl.
CPC ..... *E02B 3/068* (2013.01)

(58) Field of Classification Search
CPC combination set(s) only.
See application file for complete search history.

(56) References Cited

U.S. PATENT DOCUMENTS 6,361,252 B1 * 3/2002 Leitheiser ..... E02B 3/068 405/196

* cited by examiner

*Primary Examiner* — Kyle Armstrong
(74) *Attorney, Agent, or Firm* — Lyman Moulton, Esq.; Moulton Patents, PLLC

(57) ABSTRACT

The dock leveling system is a device to quickly and easily alter the height of the lake dock without necessitating getting into the water. The system can be installed into existing docks, or could potentially be sold with new docks. The system accomplishes the purpose of altering the height of the lake dock by the movement of a lower and upper clamp, each connected to the two foot threaded rod by an angle iron. Using a cordless drill, the top nut can be rotated clockwise or counter-clockwise. Clockwise movement of the top nut brings the two clamps together, raising the dock. Reversely, counter-clockwise movement of the top nut distances the two clamps from each other, lowering the dock frame.

20 Claims, 4 Drawing Sheets

DOCK LEVELING SYSTEM

BACKGROUND

A dock is the area of water between or next to one or a group of human-made structures that are involved in the handling of boats or ships (usually on or near a shore) or such structures themselves. The exact meaning varies among different variants of the English language. Dock may also refer to a dockyard (also known as a shipyard) where the loading, unloading, building, or repairing of ships occurs. There have been no products available as original equipment or as an aftermarket to address this problem.

In a loading dock, one problem to overcome is the problem of bridging the gap between a boat and the dock. Not all boats are the same height, and the height of the water can vary according to weather or the day. Thus there is not only a gap to bridge but a height difference to overcome. There have been no products available as original equipment or as an aftermarket to address this problem either.

There exists a need for a dock leveling system that is not being met by any known or disclosed device or system of present.

SUMMARY OF THE INVENTION

The dock leveling system is a device to quickly and easily alter the height of the lake dock without necessitating getting into the water. The system can be installed into existing docks, or could potentially be sold with new docks. The system accomplishes the purpose of altering the height of the lake dock by the movement of a lower and upper clamp, each connected to the two foot threaded rod by an angle iron. Using a cordless drill, the top nut can be rotated clockwise or counter-clockwise. Clockwise movement of the top nut brings the two clamps together, raising the dock. Reversely, counter-clockwise movement of the top nut distances the two clamps from each other, lowering the dock frame.

Figure 1:
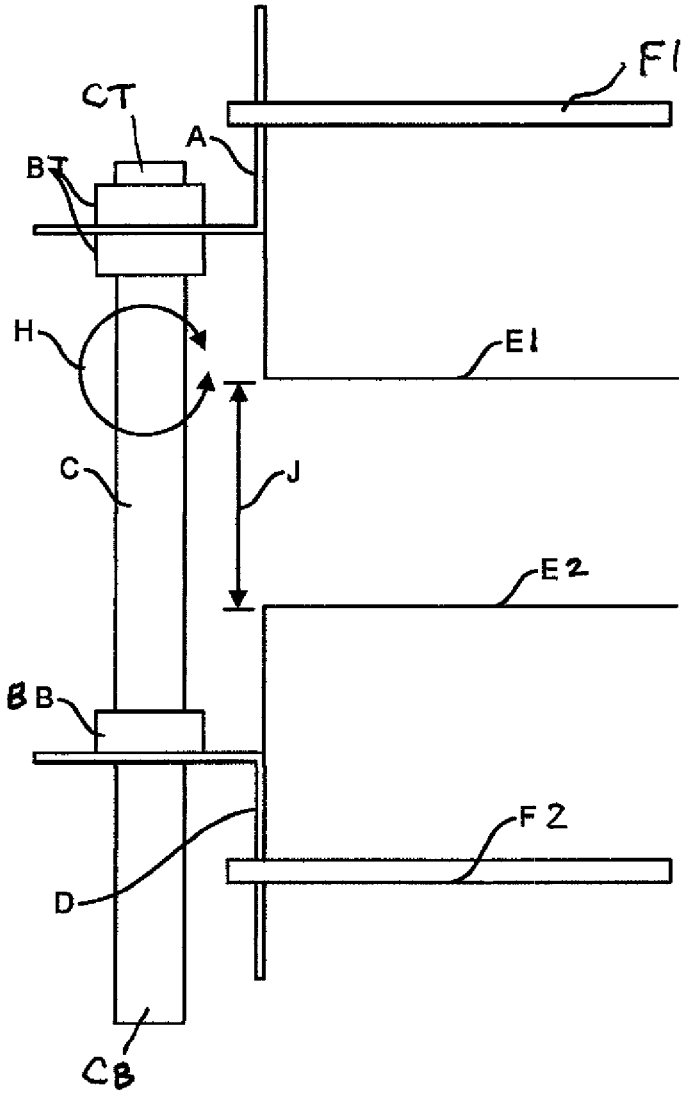
FIG. 1 is a lateral view of a two sided dock leveling system in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure the term [term] is used to refer to [describe, rest of sentence]. The term [term] refers to [describe, rest of sentence].

FIG. 1 is a lateral view of a two sided dock leveling system in accordance with an embodiment of the present disclosure. A two foot threaded rod C forms the backbone of the system and device. On the top CT and towards the bottom CB of said rod are placed two threaded nuts BT welded to the threaded rod C at the top thereof and threaded nut BB welded to bottom bracket D, which each comprise an angle iron. The top two threaded nuts BT holds the top angle iron A also known as a bracket proximal the top where it slidingly holds the rod C, and the bottom threaded nut BB holds the bottom angle iron D. Each angle iron A and D is attached respectively to a c-clamp F1 and F2, and is indirectly connected to the respective dock portion E1 and E2. The threading motion H moves the two sides of the dock towards each other or further away depicted by the arrows J depending on a threading direction.

A dock leveling system for a two sided dock including a fixed side E1 of the dock and a free side of the dock E2 with respect to the threaded rod C. The system includes a threaded rod C comprising a length equal to and greater than a height of a leveling adjustment J between the free side of the dock E2 in relation to the fixed side the dock E1. The system also includes a thread in the bracket D affixed to a bottom-side portion of the dock configured to receive a bottom portion CB of the threaded rod C wherein the thread of the threaded bracket D matches the thread of the threaded rod C. The system further includes a receiving bracket A affixed to a top side portion CT of the threaded rod C, wherein a receiving portion of the receiving bracket A holds the threaded rod C in a predetermined sliding position during threading of the threaded rod C.

Figure 2:
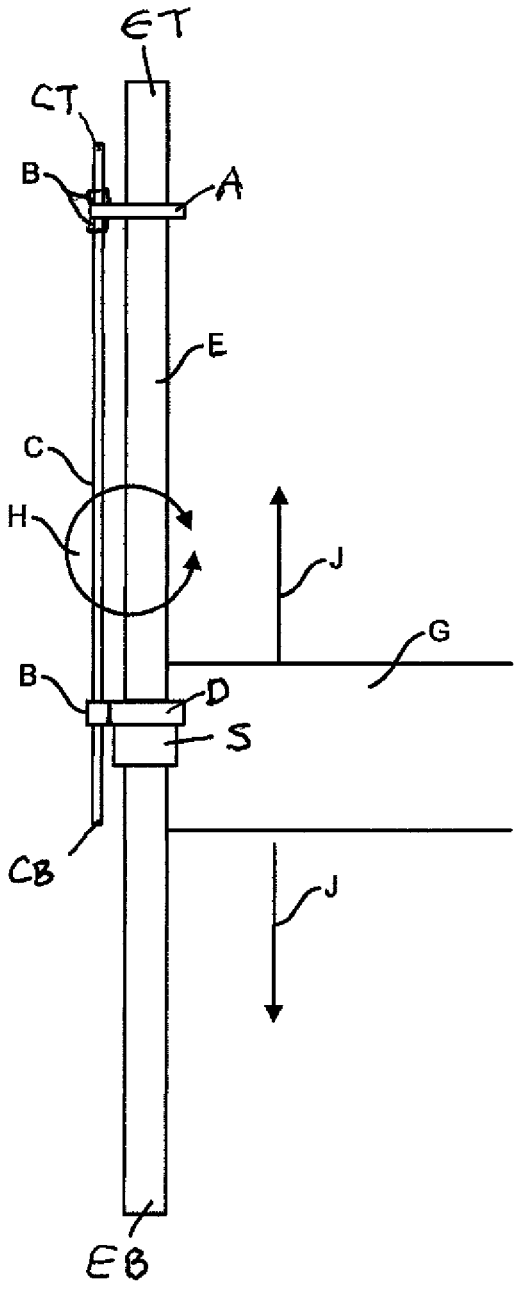
FIG. 2 is a lateral view of a one sided dock leveling system shown with the deck frame in accordance with an embodiment of the present disclosure.

FIG. 2 is a lateral view of a one sided dock leveling system shown with the deck frame in accordance with an embodiment of the present disclosure. Again the threaded rod C has two threaded nuts BT at the top CT, and another BB towards the bottom end CB of the threaded rod C. Each of the threaded nuts is connected to the respective c-clamp A and D and where D is fastened to the deck frame G. The threading motion H moves the one dock frame up and down from a fixed end of the rod CT on a post E proximal the top end of the post ET and the bottom end of the post in the earth at end EB or in another structure according to the direction arrows J. The sleeve S is fastened to the deck frame G in embodiments to allow the post a sliding movement therein.

The one sided dock leveling system for a free side of the threaded rod CB adjacent the dock deck G includes a threaded rod C comprising a length equal to and greater than a height of a leveling adjustment J between the free side of the threaded rod CB and a fixed end of the threaded rod CT in relation to the post E and the deck G. The embodied system also includes a threaded bracket affixed proximal CB and to the dock configured to receive a bottom portion of the threaded rod wherein a thread of the threaded bracket matches a thread of the threaded rod.

Figure 3:
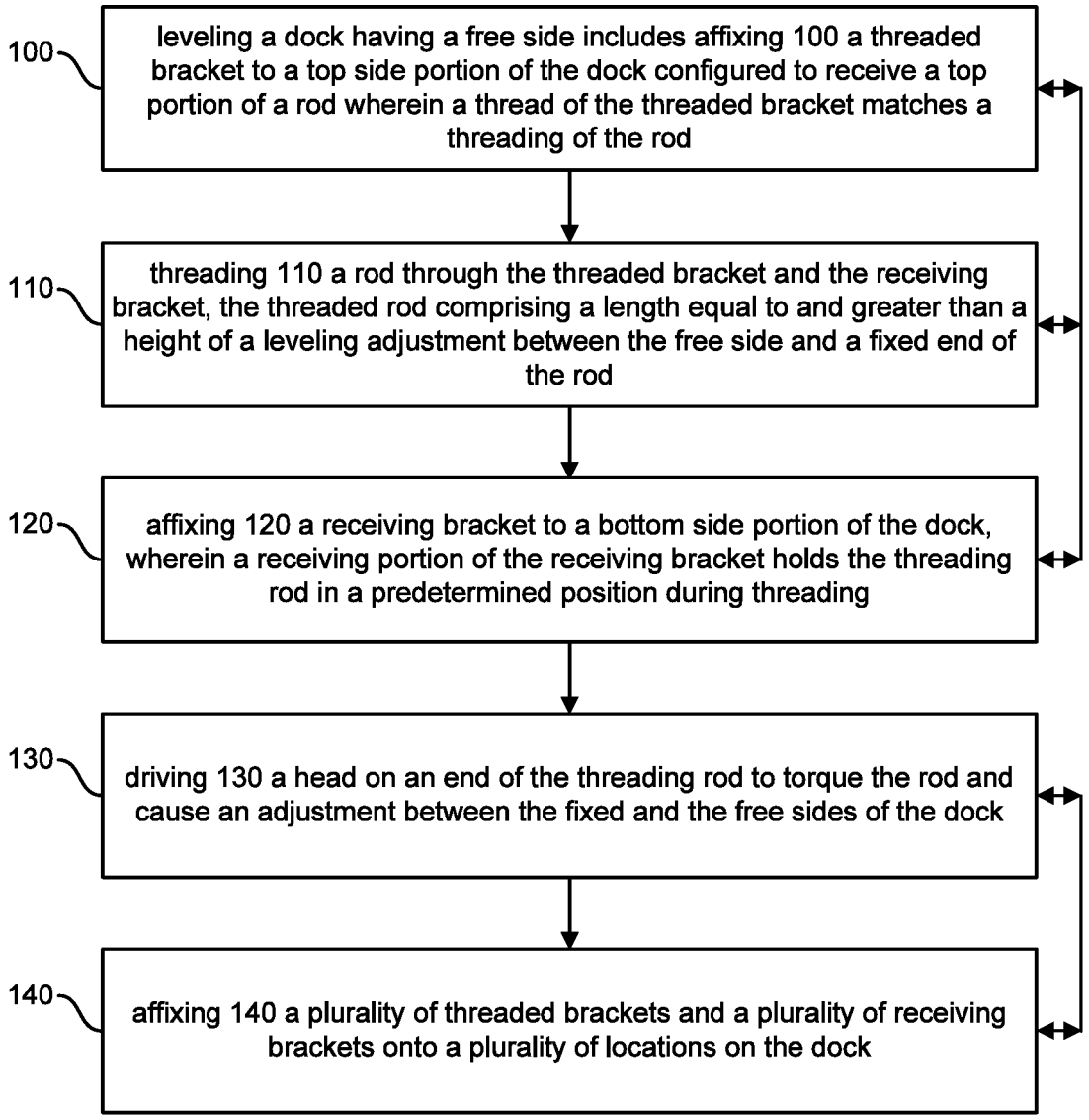
FIG. 3 is a flow chart of a method of leveling a one sided dock in accordance with an embodiment of the present disclosure.
Figure 4:
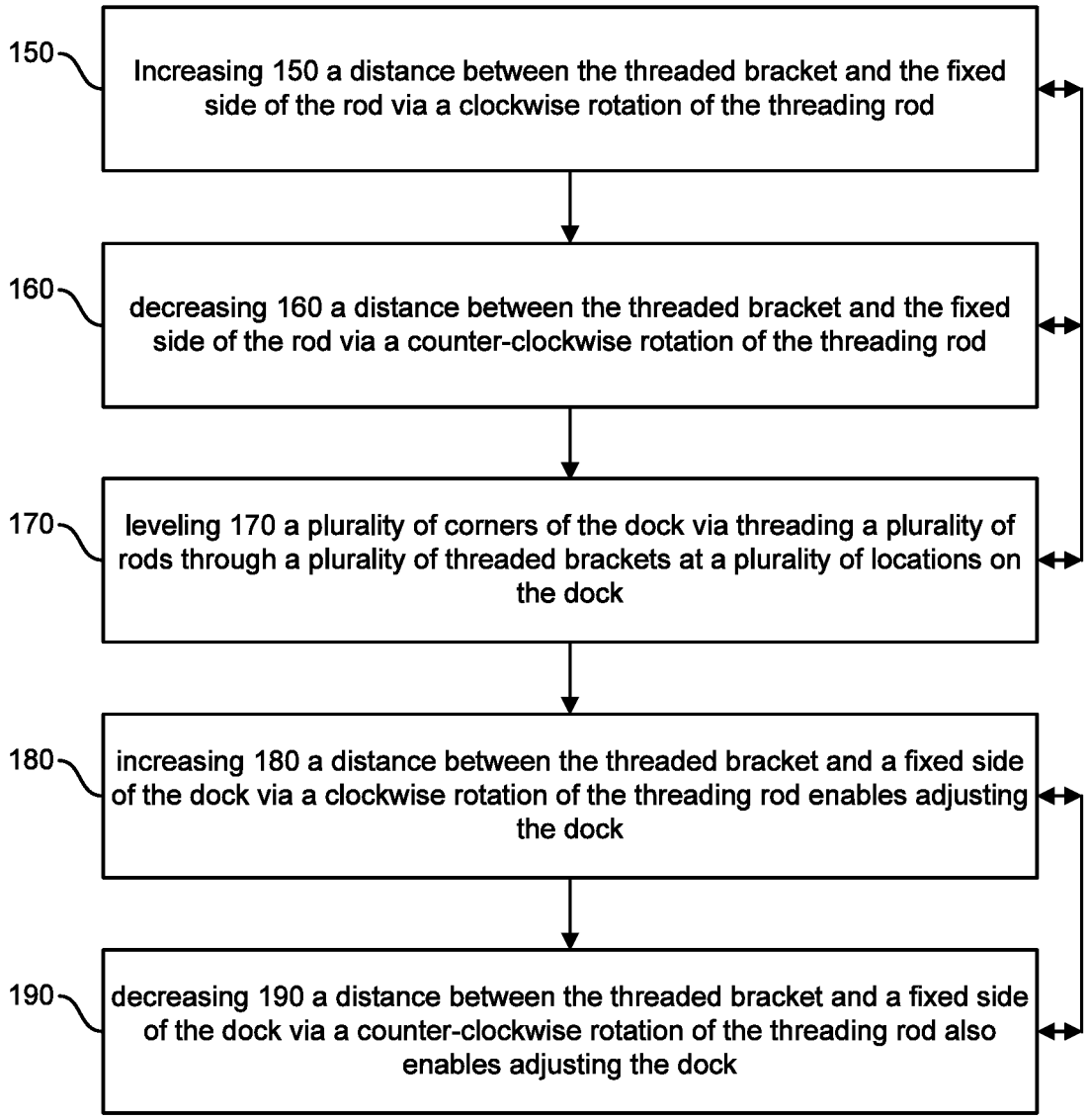
FIG. 4 is a flow chart of a method of leveling a two sided dock in accordance with an embodiment of the present disclosure.

FIG. 3 is a flow chart of a method of leveling a one sided dock in accordance with an embodiment of the present disclosure. The method of leveling a dock having a free side includes affixing 100 a threaded bracket to a top side portion of the dock configured to receive a top portion of a rod wherein a thread of the threaded bracket matches a threading of the rod. The method also includes threading 110 a rod through the threaded bracket and the receiving bracket, the threaded rod comprising a length equal to and greater than a height of a leveling adjustment between the free side and a fixed end of the rod.

Embodiments of the method further include affixing 120 a receiving bracket to a bottom side portion of the dock, wherein a receiving portion of the receiving bracket holds the threading rod in a predetermined position during threading. The embodied methods also include driving 130 a head on an end of the threading rod to torque the rod and cause an adjustment between the fixed and the free sides of the dock.

Further methods of the disclosure include affixing 140 a plurality of threaded brackets and a plurality of receiving brackets onto a plurality of locations on the dock. The embodied methods additionally include increasing 150 a distance between the threaded bracket and the fixed side of the rod via a clockwise rotation of the threading rod and decreasing 160 a distance between the threaded bracket and the fixed side of the rod via a counter-clockwise rotation of the threading rod.

Embodiments of the disclosed method include leveling 170 a plurality of corners of the dock via threading a plurality of rods through a plurality of threaded brackets at a plurality of locations on the dock. Also, increasing 180 a distance between the threaded bracket and a fixed side of the dock via a clockwise rotation of the threading rod enables adjusting the dock. On the other hand, decreasing 190 a distance between the threaded bracket and a fixed side of the dock via a counter-clockwise rotation of the threading rod also enables adjusting the dock.

A horizontal application of the threaded bracket and the threading rod are used to adjust a horizontal distance between a first dock and a second dock in some embodiments of the disclosure where the height adjustment J becomes a horizontal adjustment between respective docks via the threaded rod C and the two top nuts, receiving bracket A and the bottom nut and threaded bracket.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A dock leveling system for a fixed side of the dock and a free side of the dock, the dock leveling system comprising:

a threaded rod comprising a length equal to and greater than a height of a leveling adjustment between the free side of the dock in relation to the fixed side the dock and having a two nut head and a bracket space there between the two nuts at a top portion of the threaded rod;

a threaded bracket affixed to the free side of the dock configured to receive a bottom portion of the threaded rod in relation to the top portion and to a deck of the dock wherein a thread of the threaded bracket matches a thread of the threaded rod; and a receiving bracket affixed to the fixed side of the dock, and slidingly holds the threaded rod in a predetermined fixed position at the bracket space during threading, thereby changing the height of the leveling adjustment.

2. The dock leveling system of claim 1, wherein the two nut head is affixed to the threaded rod, and configured to torque the threaded rod in response to a power driver on the two nut head.

3. The dock leveling system of claim 1, wherein the threaded bracket and the receiving bracket are affixed to respective dock sides via a respective "C" clamp.

4. The dock leveling system of claim 1, wherein the threaded bracket and the receiving bracket are affixed to respective dock sides via respective lag bolts.

5. The dock leveling system of claim 1, wherein the two nut head is welded to the threaded rod to prevent a passage of the threaded rod through the receiving bracket.

6. The dock leveling system of claim 1, further comprising a plurality of threaded rods, a plurality of threaded brackets and a plurality of receiving brackets to adjust a level of a plurality of locations on the dock.

7. A dock leveling system for a first dock and a second dock, the dock leveling system comprising:

a threaded rod comprising a length equal to and greater than a horizontal distance adjustment between the first dock in relation to the second dock and having a two nut head and a bracket space there between the two nuts at a first portion of the threaded rod;

a receiving bracket affixed to the first dock and configured to slidingly hold the threaded rod in a fixed position at the bracket space during threading, thereby changing the horizontal distance adjustment between the first dock and the second dock; and a threaded bracket affixed to the second dock configured to receive a second end of the threaded rod wherein a thread of the threaded bracket matches a thread of the threaded rod.

8. The dock leveling system of claim 7, wherein the two nut head is affixed to the threaded rod, and configured to torque the threaded rod in response to a power driver on the two nut head.

9. The dock leveling system of claim 7, wherein the two nut head is welded to the threaded rod to prevent a passage of the threaded rod through the receiving bracket.

10. The dock leveling system of claim 7, further comprising a plurality of threaded rods, a plurality of threaded brackets to adjust a level of a plurality of locations on the dock.

11. A method of leveling a dock having a free side, the method comprising:

affixing a threaded bracket to a top side portion of the dock configured to receive a top portion of a rod wherein a thread of the threaded bracket matches a threading of the rod; and threading a rod through the threaded bracket and the receiving bracket, the threaded rod comprising a length equal to and greater than a height of a leveling adjustment between the free side and a fixed end of the rod.

12. The method of claim 11, further comprising affixing a receiving bracket to a bottom side portion of the dock, wherein a receiving portion of the receiving bracket holds the threading rod in a predetermined position during threading.

13. The method of claim 11, further comprising driving a head on an end of the threading rod to torque the rod and cause an adjustment between the fixed and the free sides of the dock.

14. The method of claim 11, further comprising affixing a plurality of threaded brackets and a plurality of receiving brackets onto a plurality of locations on the dock.

15. The method of claim 11, further comprising increasing a distance between the threaded bracket and the fixed side of the rod via a clockwise rotation of the threading rod.

16. The method of claim 11, further comprising decreasing a distance between the threaded bracket and the fixed side of the rod via a counter-clockwise rotation of the threading rod.

17. The method of claim 11, further comprising leveling a plurality of corners of the dock via threading a plurality of rods through a plurality of threaded brackets at a plurality of locations on the dock.

18. The method of claim 11, further comprising increasing a distance between the threaded bracket and a fixed side of the dock via a clockwise rotation of the threading rod.

19. The method of claim 11, further comprising decreasing a distance between the threaded bracket and a fixed side of the dock via a counter-clockwise rotation of the threading rod.

20. The method of claim 11, further comprising a horizontal application of the threaded bracket and the threading rod to adjust a horizontal distance between a first dock and a second dock.

* * * * *